United States Patent [19]

Rutledge et al.

[11] 4,312,504

[45] Jan. 26, 1982

[54] SYSTEM FOR CONVERTING SYNTHETIC TURF SURFACES FROM ONE TO ANOTHER CONDITION

[75] Inventors: Loren R. Rutledge, St. Louis; James B. Siegle, Bridgeton, both of Mo.

[73] Assignee: Monsanto Company, St. Louis, Mo.

[21] Appl. No.: 888,188

[22] Filed: Mar. 20, 1978

[51] Int. Cl.[3] ..... A63J 3/00

[52] U.S. Cl. ..... 272/3; 273/DIG. 13; 428/17

[58] Field of Search ..... 272/3, 109, 100; 273/195 A, 34 B, 176 R, 176 A, 176 B, 176 D, 176 E, 176 F, 176 FA, 176 FB, 176 FC, 176 G, 176 H, 176 J, 176 K, 176 L, DIG. 13, 27, 29 R, 31; 404/71; 428/15, 17, 27, 33, 45, 62, 81, 82, 83; 52/222; 16/4, 16, DIG. 3

[56] References Cited

U.S. PATENT DOCUMENTS

| | | | |
|---|---|---|---|
| 3,407,714 | 10/1968 | Henderson | 272/3 |
| 3,418,897 | 12/1968 | Humalainen | 272/3 |
| 3,433,137 | 3/1969 | Henderson | 272/3 |
| 3,880,432 | 4/1975 | Coffey et al. | 273/195 A |
| 4,007,307 | 2/1977 | Friedrich | 428/17 |
| 4,067,757 | 1/1978 | Layman | 272/3 X |

FOREIGN PATENT DOCUMENTS

| | | | |
|---|---|---|---|
| 2023630 | 11/1971 | Fed. Rep. of Germany | 272/3 |
| 2520550 | 11/1976 | Fed. Rep. of Germany | 272/3 |

OTHER PUBLICATIONS

Exhibit A–supplied by applicant's attorney.

*Primary Examiner*—Richard C. Pinkham
*Assistant Examiner*—Arnold W. Kramer
*Attorney, Agent, or Firm*—Michael J. Murphy

[57] ABSTRACT

In a system for converting a synthetic turf surface area from one to another condition which includes a receiving slot below ground level containing marginal portions of synthetic turf products in wedged engagement, the improvement in converting the surface area to another condition wherein one turf product is removed which comprises a removably positioned L-shaped rigid support bearing a yieldable pad for the margin of the remaining turf product after its removal from the slot. The process comprises removing such margin from the slot, inserting one leg of the L-shaped support snugly into the exposed slot and then anchoring the margin under tension over the other leg of the L-shaped support to create a synthetic turf border with respect to the area from which the turf product was removed.

3 Claims, 4 Drawing Figures

SYSTEM FOR CONVERTING SYNTHETIC TURF SURFACES FROM ONE TO ANOTHER CONDITION

BACKGROUND OF THE INVENTION

This invention relates to synthetic turf surfaces and more particularly to a system and method for converting same from one condition to another.

Man-made synthetic turf products resemling grass such as disclosed in U.S. Pat. No. 3,332,828 have found widespread acceptance in covering parade grounds, playgrounds, highway medians, areas surrounding swimming pools, patios and the like and especially on indoor and outdoor athletic fields such as in stadiums or arenas where from time to time it may become necessary to convert the playing area from one type to another to accommodate a variety of sports and other activities. For example, in converting from a football to a baseball playing area, it may be desirable to remove portions of the turf where the base areas, pitcher's mound, batter's box, etc. are to be located, which portions will be later reinstalled in converting back to a football playing area. For optimum playing conditions the edges of abutting sections of turf products must be tightly secured in a wrinkle-free, smooth manner without ridges, corrugations or depressions, as must the edges of sections circumscribing uncovered playing areas as for example, portions of the infield when the field is in condition for baseball. To facilitate this, conversion systems for synthetic turf surface areas have been developed which are directed towards minimizing the time and effort involved in changing from one playing field condition to another.

Unfortunately, though successful, such conversion systems as have been used and as typically disclosed in U.S. Pat. No. 3,433,137 are rather complex in construction in employing elaborate and therefore costly underground trenches containing anchoring studs to which the turf edges are secured and leveling covers closing the top of the trenches after establishing the desired surface area condition. Such covers may be painstakingly adjusted to ensure a smooth transition between the two areas after anchoring the turf margins. The art therefore is in need of a simplified system for converting a synthetic turf surface area from one condition to another.

SUMMARY OF THE INVENTION

Now a system of reduced complexity has been developed for converting a synthetic turf area from one condition to another.

Accordingly, a principal object of this invention is to provide an improved system for converting a synthetic turf area from one to another condition.

Another object is to provide an improved system of reduced cost and complexity for temporarily securing a removable synthetic turf portion with respect to an adjacent permanent section.

A further object is to provide a depression-resistant joint without ridges between abutting portions of a synthetic turf surface area.

Other objects will in part be obvious and will in part appear from the following description and claims.

These and other objects are accomplished in a broad sense by providing a system for converting a synthetic turf surface area from one to another condition which comprises a receiving slot below ground level containing extractable marginal portions of synthetic turf products in wedged engagement with each other therein.

In a more specific system aspect of the invention the improvement is provided in converting the surface area to a condition where one synthetic turf product is removed exposing an adjacent area comprising, in combination, impermanently positioned support means operatively cooperating with the slot supporting the margin of the remaining turf product previously in the slot substantially coextensive with that of turf product adjacent the slot.

From a process standpoint, there is broadly provided in converting a synthetic turf surface area from one condition to another the step of wedging removable marginal portions of synthetic turf products into engagement in a receiving slot below ground level during establishment of one condition.

In a more specific process aspect of the invention, there is provided the improvement in converting such surface area to another condition wherein one synthetic turf product is removed exposing an adjacent area comprising, in combination, the following steps: providing a removable synthetic turf support means for selective use in establishing such another condition, removing the margin of the remaining turf product from the slot, covering the exposed slot with the support means to provide a penetration-resistant cover thereover, and anchoring the removed margin over the in-place support means to create a border of synthetic turf with respect to the exposed area.

BRIEF DESCRIPTION OF THE DRAWINGS

In describing the overall invention, reference will be made to the accompanying drawings wherein.

DETAILED DESCRIPTION OF THE ILLUSTRATED EMBODIMENTS

Figure 1:
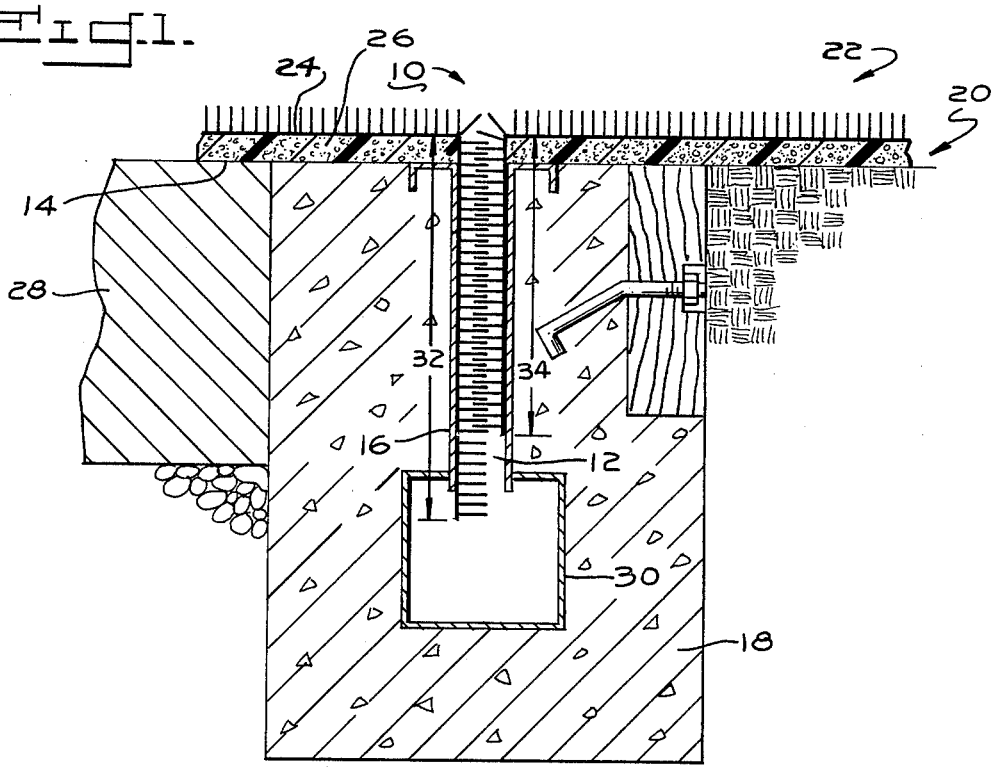
FIGS. 1 and 2 are vertical cross sectional views of a preferred form of conversion system according to the invention.
Figure 2:
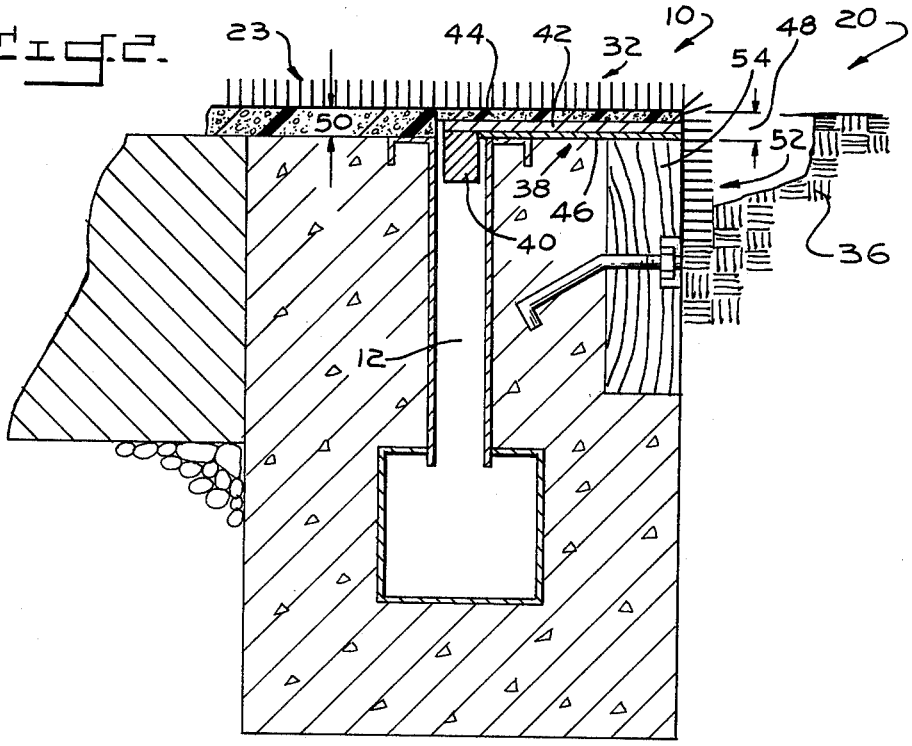

Referring now to the drawings, a periphery anchoring system collectively identified as 10 is shown in FIGS. 1 and 2 which facilitates converting a synthetic turf surface area from one condition to another, such as from that shown in FIG. 2 to that of FIG. 1 and back again.

Such system comprises margin-receiving slot 12 below and elongated in the direction of ground level 14 which is delimited by opposing, relatively closely spaced, upright, margin-engaging, substantially parallel sidewalls of a shaped rigid member such as galvanized metal line 16 rigidly anchored in place in concrete foundation 18 disposed around the perimeter of area 20 desired to be converted from a condition where covered with synthetic turf product panel 22 (FIG. 1) to one where uncovered (FIG. 2). Such conversion, for example, might be necessary in using area 22 as a racetrack, running track or sliding surface around a base in a baseball playing field condition, after having used the area in a covered condition as part of a football, soccer or the like playing area. Though preferably substantially perpendicular to ground level 14, the slot forming walls of liner 16 could optionally be angled relative to level 14 should such an orientation, for example, be found to enhance the joint between the abutting turf surfaces in a manner to be described. Slot 12 is upwardly open to ground level 14 and at its lower end to sloped drain conduit 30 for the purpose of conveying surface water entering slot 12 to a central collection area.

The synthetic turf product, which generally horizontally overlies the entire installation, may be any one or a combination of well known commercially available grades such as, for example, that sold as Astroturf® by Monsanto Company, which in a finished installation comprises synthetic grasslike portion 24 consisting of a multitude of upstanding fibers secured to a substrate which in turn is adhesively bonded to a yieldable shock-absorbing underpad 26 resting atop and preferably also bonded to a planar rigid base structure such as asphalt layer 28. The synthetic turf material is usually in the form of a plurality of large sheets extending across the area to be covered.

In establishing the condition illustrated in FIG. 1 where convertible area 22 is covered with a synthetic turf product, retractable flap or margin portions 32, 34 (which preferably are not provided with underpads) of adjacent synthetic turf product sections 22, 23 are forced down into slot 12 a distance on the order of from about one to 12 inches (5 to 30.5 cms.) in tightly wedged frictional engagement with each other to provide a seemingly continuous joint between the two adjacent turf pieces 22, 23. Leveling members requiring manual vertical adjustment to promote such continuity are non-extent in the system as are anchoring studs in wide underground trenches. In this last respect slot 12 need only be sufficiently wide in the horizontal direction parallel to level 14 as to permit establishing the wedged engagement shown, such width usually ranging between about 174 to 2 inches (1.3 to 5 cms.). The tightly embracing meshing relationship between the blade portions together with the narrow cross section of slot 12 enhance the secure relationship of interlocking margins 32, 34 along a common line of juncture as well as of sections 22, 23 of which they are integral extensions. A rope-like retainer strip (not shown) may optionally be forced down into and along the length of slot 12 in conjunction with margins 32, 34 to further promote tight secure engagement of the abutting faces. This FIG. 1 condition is typically that provided in using area 22 as part of a football playing field.

In converting from the condition of FIG. 1 to the baseball condition of FIG. 2 wherein synthetic turf panel portion 22 is removed to expose adjacent uncovered area 20 without any synthetic turf product thereon, impermanently positioned support means 38 operatively cooperates with slot 12 to support margin 32 of remaining turf product 23 previously in slot 12 substantially coextensive with that of the turf product adjacent the slot—i.e. section 23 to the left of slot 12 in FIG. 2. In the FIG. 2 position, means 38 is removably installed in supporting relationship to margin 32 and includes projecting bar portion 40 snugly removably received within the upper end of slot 12 to fix means 38 while supporting margin 32 against lateral shifting movement in the event the latter is tread on for example by a player using that portion of the playing field. Support means 38 in the embodiment illustrated is relatively short, laterally planar oriented, extends toward area 22 when in operative position and comprises rigid metal plate 42 to which is permanently secured separate yieldable underpad section 44 on its upper side and preferably clothlike underlayer 46 on its downside, the latter promoting level uniformity and serving to deaden any sound that might occur in treading on margin 32 in the event of a slight uneveness in either or the other of plate 42 or the lower asphalt surface on which layer 46 rests. The vertical thickness 48 of means 38 should be substantially equal to vertical thickness 50 of the underpad plus coatings of remaining turf portion 23. In the installed position of FIG. 2 support means 38 provides a laterally fixed rigid cover over slot 12 yet possesses a yieldable undersurface for the exposed grass-like portion of margin 32. Such rigid covering over permanent slot 12 avoids the undesirable possibility of a groove forming in the turf surface which would occur should a player tread directly on the turf over slot 12 without such rigid support.

In converting from the FIG. 1 condition to that of FIG. 2, margins 32 and 34 are forcibly extracted from slot 12 and panel 22 removed completely. The exposed slot is then fitted with support means 38 whereupon margin 32 is tensioned over underpad 44 by securing its outermost section 52 to wooden nailer 54 by any suitable means such as glue, staples, tacks or the like. Soil or equivalent (shown as 36 in FIG. 2) is then back filled in around section 52 substantially to the horizontal level of the base of the blades of margin 32 thus providing a smooth border of synthetic turf with respect to exposed area 20. In reestablishing the FIG. 1 position, portion 52 is forcibly released from nailer 54, support means 38 removed, margin 32 replaced in slot 12, panel 22 reinstalled over area 20 and its margin 34 wedged into tight engagement with margin 32 in slot 12.

Figure 3:
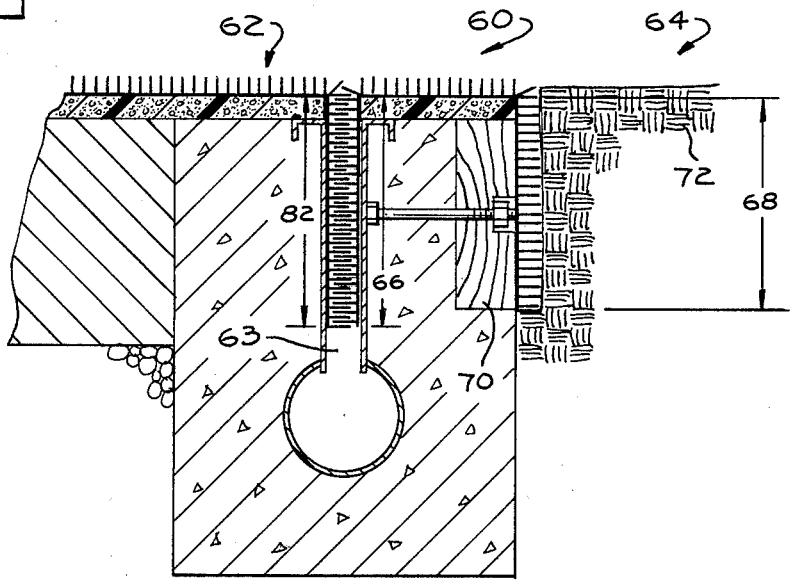
FIGS. 3 and 4 are views similar to FIGS. 1 and 2 on a slightly reduced scale of an alternate form of conversion system according to the invention.
Figure 4:
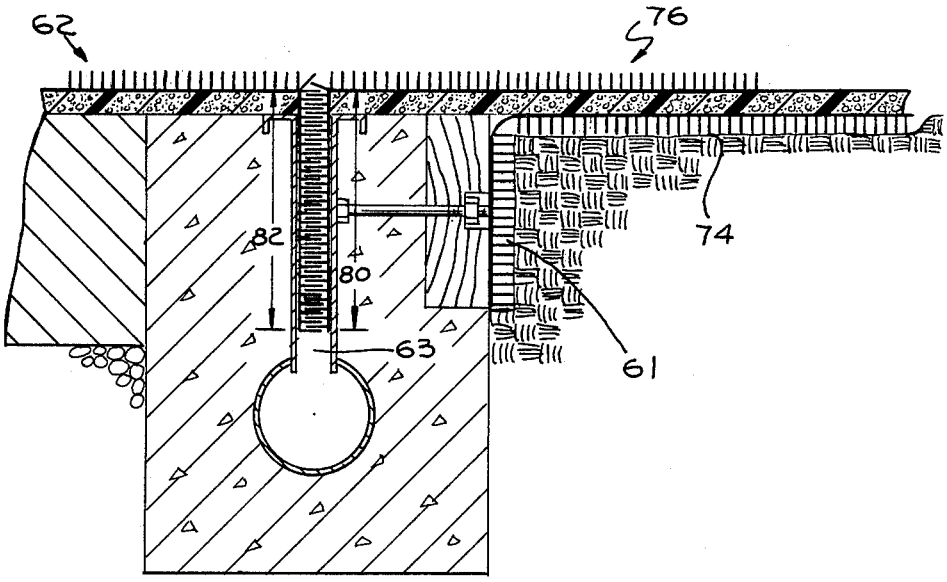

Referring now to the alternate embodiment of FIGS. 3 and 4, a synthetic turf conversion piece 60 is provided for selective manipulation with respect to slot 63 (which is similar in function to slot 12 of FIGS. 1 and 2) and adjacent permanent synthetic turf section 62 in establishing the FIGS. 3 and 4 conditions, conversion piece 60 having a permanently anchored margin section 61 which is preferably not disturbed in converting from one condition to the other. Piece 60 is characterized as having a reduced surface area with respect to adjacent, permanently installed synthetic turf section 62. In the field condition of FIG. 3 wherein area 64 is exposed without a synthetic turf covering, margin 66 of conversion piece 60 is in wedged engagement with margin 82 of adjacent section 62 in slot 63 while the other end 68 of conversion piece 60 is secured to nailer 70 and covered with dirt 72. In converting to the FIG. 4 position with this system, margin 66 is dislodged from slot 63 and piece 60 is peeled back away from slot 63 into adjacent storage cavity 74 roughly formed out of the surrounding dirt. Next removable synthetic turf conversion panel 76 is juxtaposed over area 64 (including the stored conversion piece portion) to establish the other playing condition wherein panel 76 is substantially coextensive with permanently installed section 62. To complete the change to this position, unpadded margin 80 of panel 76 is wedged into abutting engagement with margin 82 of section 62 in slot 63.

The above description and particularly the drawings are set forth for purposes of illustration only and are not to be taken in a limited sense. Various modifications and alterations will be readily suggested to persons skilled in the art. It is intended, therefore, that the foregoing be considered as exemplary only and that the scope of the invention be ascertained from the following claims.

What is claimed is:

1. In an area containing synthetic turf which is convertible from one surface condition which includes synthetic turf on such area to another surface condition which includes an exposed portion of such area having no synthetic turf, wherein said one surface condition includes two sections of synthetic turf having marginal portions held in wedged engagement in a receiving slot located below ground level with the remainder of the sections coextensively covering such area, which conversion requires (1) the removal of both marginal portions and one of the sections to provide said exposed portion of the area of said another surface condition, and (2) the subsequent repositioning of a section and anchoring of its marginal portion with the marginal portion of the unremoved section of synthetic turf to provide said one condition; the improvement which comprises an L-shaped support means for cooperation with said slot when said marginal portions are removed in providing said another condition, one leg of said L-shaped support means projecting snugly within said slot with the remaining leg extending toward the portion of such area having no synthetic turf and supporting the margin of the remaining synthetic turf section previously in the slot substantially coextensive with the rest of such remaining turf section, thereby providing a penetration-resistant cover.

2. The synthetic turf of claim 1 wherein the support means includes a rigid base portion overlying the slot.

3. The synthetic turf of claim 2 wherein the support means includes an underpad secured to the base portion.

* * * * *